United States Patent [19]

Kaufman

[11] 4,080,907

[45] Mar. 28, 1978

[54] SHELF FABRICATED FROM A SINGLE SHEET OF THERMALLY DEFORMABLE MATERIAL

[76] Inventor: Ric Kaufman, 2505 Mariposa, San Francisco, Calif. 94110

[21] Appl. No.: 761,197

[22] Filed: Jan. 21, 1977

[51] Int. Cl.[2] ..... A47B 55/00

[52] U.S. Cl. ..... 108/59; 211/73; 248/174

[58] Field of Search ..... 108/59, 92, 111; 248/174; 211/135, 73, 153; 312/259

[56] References Cited

U.S. PATENT DOCUMENTS

| | | | |
|---|---|---|---|
| 335,136 | 2/1886 | Leonard et al. | 211/153 |
| 1,124,175 | 1/1915 | Sackett | 108/59 |
| 1,916,647 | 7/1933 | Walker | 248/174 |
| 2,155,190 | 4/1939 | Heinz | 211/135 |
| 2,439,690 | 4/1948 | Lippenberger | 248/174 X |
| 2,900,667 | 8/1959 | Longenecker | 248/174 X |
| 2,918,178 | 12/1959 | Leone | 248/174 X |

FOREIGN PATENT DOCUMENTS

| | | | |
|---|---|---|---|
| 446,236 | 1/1948 | Canada | 211/73 |

*Primary Examiner*—Francis K. Zugel
*Attorney, Agent, or Firm*—Townsend and Townsend

[57] ABSTRACT

A new shelf and a method for its fabrication from a single generally rectangular sheet of thermally deformable material. First and second spaced apart axes are selected which extend across the width of the sheet. Third and fourth spaced apart axes are selected which extend longitudinally of the sheet perpendicular to the first and second axes. The third and fourth axes are spaced from the side edges to define opposing sidewall portions. A u-shaped cut, both ends of which terminate within the margins of the sheet, is made in the medial portion of the sheet along segments of the axes. The cut defines a frontal edge, opposing shelf ends having tabs, and opposing shelf end receiving slots in the sidewall portions. The sheet is heated along specified axes and simultaneously the shelf and the sidewall portions are orthogonally bent outward from the sheet, and the tabs are inserted in the shelf end receiving slots. The shelf and its rear wall form an L-beam. The tab-to-slot joints and the L-beam configuration of the shelf provide the shelf with a bending resistancy when loaded. A single sheet can be formed into a conventional shelf case having a plurality of shelves, by making a plurality of such U-shaped cuts at preselected intervals along a sheet of material.

1 Claim, 5 Drawing Figures

SHELF FABRICATED FROM A SINGLE SHEET OF THERMALLY DEFORMABLE MATERIAL

BACKGROUND OF THE INVENTION

Various display cartons, advertising devices and folding structures typically fabricated of cardboard are heretofore known. For example, see FLYNN, U.S. Pat. No. 1,491,091, SCHWARTZ, U.S. Pat. No. 2,788,596 and THOMAS, U.S. Pat. No. 3,508,734. Such foldable devices, however, have numerous disadvantages when considering the fabrication of permanent shelving.

First, they are typically fabricated of a material not having the property of angular memory when formed. That is to say, in their fabrication cardboard or the like is typically freely hinged about the fold axis. Once hinged and bent, it no longer preserves any angular rigidity. Structural soundness is typically lost along the plane of the hinge.

Moreover, such units are typically comprises of separately cut pieces, folded separately and thereafter joined one to another. Multi-piece fabrication requires an undue amount of time and often results in significant material wastage.

Also disclosed in the prior art is a method of making a one-piece display device formed from a single sheet of plastic. The sheet is cut or slit and bent at various points after heating. While this method overcomes many of the shortcomings noted above, the structures thus fabricated have a number of disadvantages which are foreign to the present invention. The method does not yield a conventional, simple shelf case having two sidewalls, a rear wall, and at least one horizontal shelf. Instead, it yields rather complex, multi-level, multi-angled, cantilevered display devices. Complex cuts and folds must be made. The devices are not suitable for wall mounting. The shelves have little bending resistancy when loaded. All of the display devices fabricated utilizing this method are unsuitable for use as book cases.

In contrast, the present invention yields a conventional, simple shelf structure. A minimal number of cuts and folds is required. The cuts are made with rounded corners to reduce the liklihood of cracking that might occur if right-angle cuts defining sharp corners were made. Carefully located apertures linking segments of the cut defining a single shelf, allow the shelf to be bent to form an L-beam configuration and allow the tabs of the shelf ends to be inserted into slots in the sidewalls without buckling of material at the corners. The tab-to-slot joints and the L-beam configuration result in a sturdy shelf which resists bending even under considerable loading conditions. The shelf case of the present invention is readily adaptable to wall mounting which further adds strength by providing rear wall cross bracing.

SUMMARY OF THE INVENTION

A new shelf and a method for its fabrication are disclosed. At least one shelf may be formed from a single generally rectangular sheet of preferably thermally deformable material. First and second spaced apart axes are selected which extend across the width of the sheet, parallel to the end edges of the sheet. Third and fourth spaced apart axes are selected which extend longitudinally of the sheet perpendicular to the first and second axes, and which are spaced from the side edges to define opposing sidewall portions. A u-shaped cut, both ends of which terminate within the margins of the sheet, is made in the medial portion of the sheet along segments of the axes. The cut defines a frontal shelf edge along the second axis, opposing shelf ends having tabs along the third and fourth axes, and opposing shelf end receiving slots along the first axes. A pair of opposing apertures are cut which link the segments of the cut defining the shelf ends and the shelf end receiving slots.

The sheet is preferably simultaneously heated at preselected folding axes in order to bend the shelf and the sidewall portions orthogonally outward from the plane of the sheet. The apertures facilitate the clearance necessary to insert the tabs in the shelf end receiving slots without buckling adjacent portions of the sheet.

Upon cooling the respective folded portions maintain their rigid angular disposition to one another. The shelf and its now defined rear wall form an L-beam. The tab-to-slot joints and the L-beam configuration provide the shelf with a bending resistancy when loaded. A single sheet can be formed into a shelf case having a plurality of shelves, by making a plurality of such u-shaped cuts at preselected intervals along the sheet of material. A pattern may be directly scribed on the sheet to be formed prior to cutting or a pre-cut onlay template may be utilized.

The objects and advantages of the present invention are as follows:

A single sheet of thermally deformable material may be formed into a simple shelf case which becomes a three dimensional reinforcing matrix. The L-beam structure and the tab-to-slot joints allow the shelves to be made surprisingly long without warping or bending when loaded. This bending resistancy is an unexpected result and may be further enhanced by folding the front edge of the shelves downward so as to be parallel with the rear wall.

Stuctural rigidity results from the fact that the shelf is fabricated from a material having the property of angular memory when formed. Various cartons and other folding structures heretofore manufactured of cardboard and the like do not have the rigidity and reinforcing characteristics of the present invention.

Because the tabs are not bonded to the shelf end receiving slots the shelf case of the present invention can flex upon impact without characteristic cracking of the material. Cracking is undesirable since it interferes with both the structural rigidity and the aesthetic appearance of the shelf.

The one-piece, simple cut, minimal folding characteristics of the present invention result in very little wastage of material and in significant savings in assembly time.

The novel features which are believed to be characteristic of the invention, will be better understood from the following description considered in connection with the accompanying drawings. Preferred embodiments of the invention are illustrated by way of example. It is to be expressly understood, however, that the drawings are for the purpose of illustration and description only and they are not intended as a definition of the limits of the invention.

DESCRIPTION OF THE PREFERRED EMBODIMENT

Figure 2:
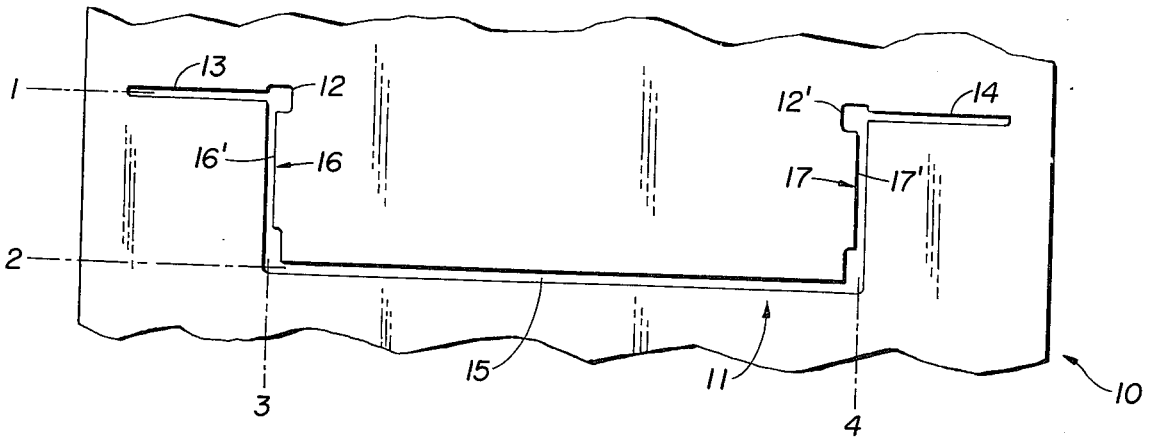
FIG. 2, is a plan view of a portion of a single sheet of thermally deformable material cut for forming one shelf. The sheet may be used either to form the shelf itself or as an overlay template to be used in making a plurality of cuts in a second sheet of material which may be formed into a shelf case having a plurality of shelves.

FIG. 2 illustrates a portion of a sheet 10 of thermally deformable material. Various plastics as well as other materials are suitable. However, it is critical, for the purposes of the present invention, that the material have a memory which may be broken upon the application of heat. Upon the application of heat, a sheet of such material may be bent where it has been heated. When the sheet of material cools it maintains angular rigidity.

One suitable material is PLEXIGLASS, an acrylic sheet made by Rohm & Haas, Philadelphia, Pa. 19105. Referring again to FIG. 2 spaced apart axes 1 and 2 are depicted. Spaced apart axes 3 and 4 lie perpendicular to axes 1 and 2. A continuous cut generally designated 11, is made in the medial portion of the sheet. The cut may be made with a router or other such machine tool which is first inserted and used to cut through the sheet to form a square 12. It may also be possible to stamp out cut 11 by utilizing a mechanical press with an appropriate die.

Opposing squares 12 and 12' have a two-fold purpose: First they provide a convenient place for the machine tool to enter the material and begin the cut without damaging the sheet or drifting beyond the marked cut, and secondly, they provide the necessary clearance to allow the shelf to be bent and the shelf end tabs to be inserted into the shelf end receiving slots as will later be discussed. Without the squares, the shelf end tabs could not be inserted into the shelf end receiving slots without buckling the shelf, the rear wall, or the sidewall portions.

The machine tool is moved in order to cut opposing shelf end receiving slots 13 and 14 along axis 1. Slots 13 and 14 extend outwardly from axes 3 and 4 respectively. One longitudinal length of the shelf 15 is cut along axis 2 from axis 3 to axis 4. Cuts are made along axes 3 and 4 from axis 1 to axis 2 to define shelf ends generally designated 16 and 17. Shelf ends 16 and 17 have tabs 16' and 17' respectively. It is desirable that the width of the slots be only slightly greater than the gauge or thickness of the sheet so that the tabs will fit snugly into the slots.

It is important for purposes of the present invention, that all cuts be made with rounded corners, and not with straight, right-angle corners. Rounded corners enable the completed shelf to receive greater stress in the regions adjacent the bending points without cracking of the material.

Figure 3:
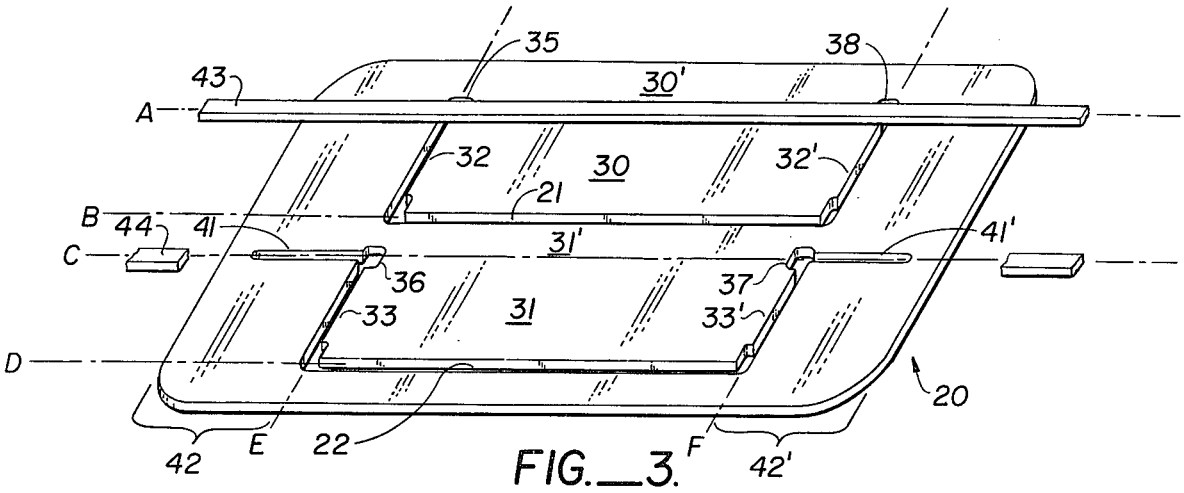
FIG. 3, is a perspective view of a single sheet of thermally deformable material which has two separate and distinct u-shaped cuts which have been made utilizing the sheet of FIG. 2 as an overlay template.

Referring now to FIG. 3, a sheet 20 of thermally deformable material is shown. Pairs A and B, C and D, and E and F of spaced apart axes are shown. Sheet 20 has two continuous cuts generally designated 21 and 22. The cuts are made to conform to the cut made in sheet 10. This may be done by first appropriately scribing patterns on sheet 20 and then cutting or by utilizing sheet 10 as an overlay template and successively positioning sheet 10 to make cuts 21 and 22.

The cuts define two shelves, 30 and 31, which have tabs 32, 32', and 33, 33' at their opposing ends, respectively. The cuts also define apertures 35–38, and shelf end receiving slots 40, 40' (not visible in FIG. 3), and 41, 41'. Rear wall portions 30' and 31' of shelves 30 and 31, respectively, are depicted.

Sheet 20 preferably has a preselected length and width, and the cuts are preferably of preselected length, width and location so that the completed shelf case has a conventional three-to-two height-to-width ratio that is aesthetically pleasing.

Bending axes E and F define sidewall portions 42 and 42' of sheet 20 which run the entire length of sheet 20 to the left and right of axes E and F, respectively. Bending axes A and C define the rear boundaries of shelves 30 and 31 respectively.

Heat element 43 is shown lying atop sheet 20 along axis A. A fractional portion of heat element 44 is depicted. It lies along axis C in the same fashion. The heating portions of heat elements 43 and 44 preferably extend along axes A and C, respectively, only between axes E and F. The heat elements are a conventional type used in the plastic industry. They may be made of cloth which is draped around metal conductors. Electric current is passed through the metal conductors in order to heat the sheet at the bending axes. In the case of PLEXIGLASS, a temperature in the range of 265° to 300° F. is sufficient.

The heat elements can be placed against sheet 20 from the bottom also. Alternatively, the entire sheet can be heated and bent where desired. It is possible to load the sheet in an oven-like structure which has surrounding heat elements, proximate the bending axes. In general, any method of bending known in the plastic industry may be utilized.

Figure 4:
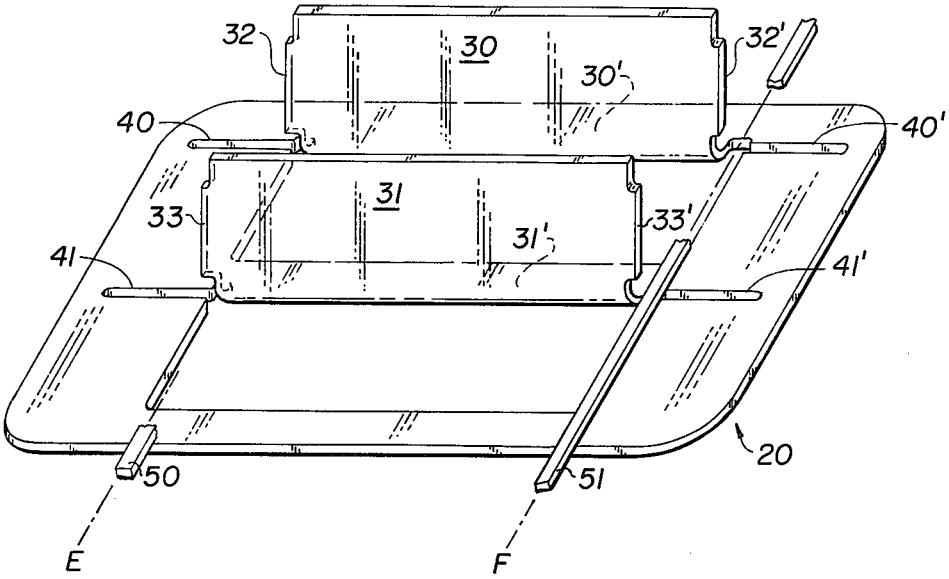
FIG. 4, is a perspective view of the sheet of FIG. 3 after the shelves have been bent orthogonally outward from the plane of the sheet.

Referring now to FIG. 4, sheet 20 of FIG. 3 is shown. Heat elements 43 and 44 have been removed and shelves 30 and 31 have been bent orthogonally outward from the plane of sheet 20. Shelf 30 and rear wall portion 30' form an L-beam, as do shelf 31 and rear wall portion 31'. Tabs 32, 32' of shelf 30 and tabs 33, 33' of shelf 31 are depicted. Also shown in FIG. 4 are shelf end receiving slots 40, 40', 41 and 41'. Fragmentary portions of heat elements 50 and 51 are shown. They lie atop sheet 20 along axes E and F, respectively.

Figure 5:
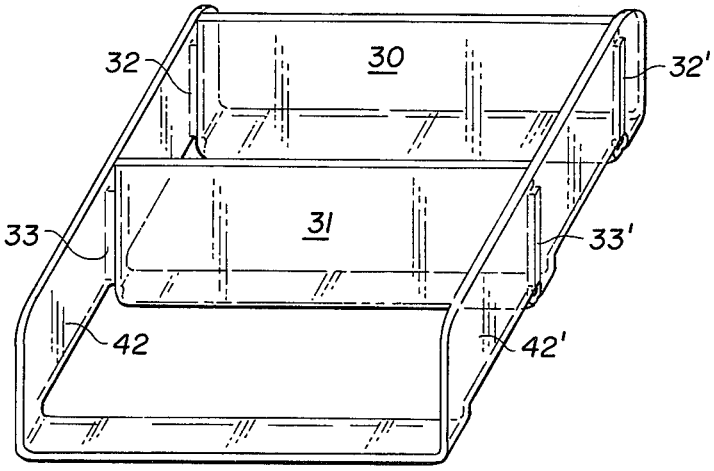
FIG. 5, is a perspective view of the sheet of FIG. 4 after the shelf sidewalls have been bent orthogonally outward and the tabs have been inserted in the shelf end receiving slots.

In FIG. 5 heat elements 50 and 51 have been removed and sidewall portions 42 and 42' have been bent orthogonally outward from sheet 20. Tabs 32 and 32' have been inserted in shelf end receiving slots 40 and 40'. Tabs 33 and 33' have been inserted in shelf end receiving slots 41 and 41'.

No tab-to-slot bond is made. This allows the completed shelf case to flex upon impact and thereby resist cracking. Since a single sheet is used to form the shelf structure, there is very little wasted material which results in substantial economic savings per unit manufactured. Further savings result since no fasteners or bonding agents are utilized. The necessity for multipiece assembly is eliminated which results in fast and easy fabrication. The resulting shelf case is lightweight and sturdy as well as aesthetically appealing because of its rounded corners and edges and smooth surface texture.

The front edges of the shelves may be folded downward to further increase their bending resistance.

Figure 1:
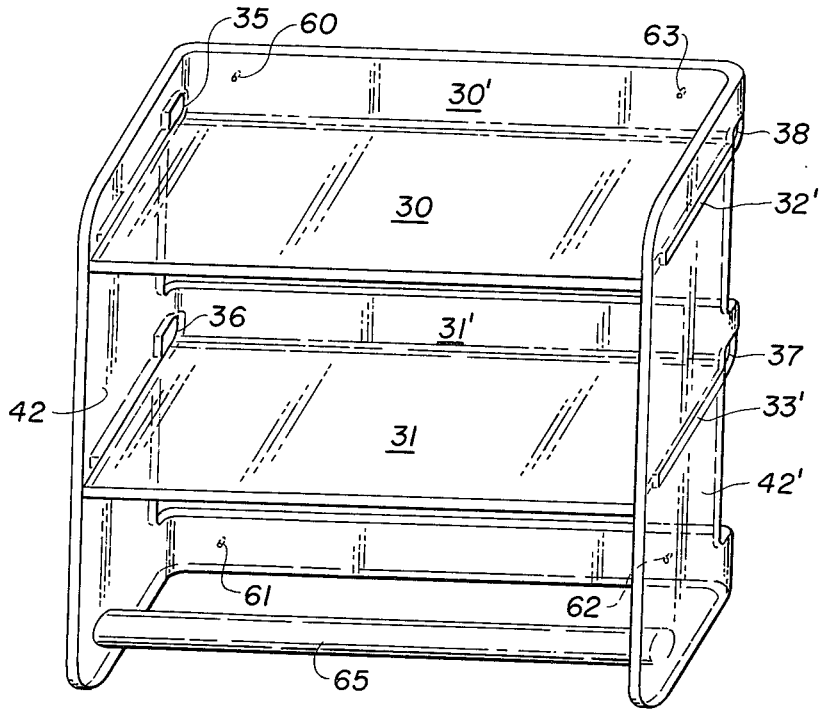
FIG. 1, is a perspective view of one embodiment of the present invention. The shelf case illustrated is formed in FIGS. 3, 4 and 5.

FIG. 1 illustrates the shelf case formed in FIGS. 3–5 in a free standing position. Apertures 35–38 are depicted. Holes 60–63 may be drilled in the back wall of the shelf to receive screws or nails for mounting the shelf case to a wall. This type of mounting further adds strength and stability to the shelf case since it acts as a form of real wall crossbracing. Alternatively, two such shelf structures may be secured back to back, or a plurality of back to back units may be secured together side by side to form a self-reinforcing store display. A rod 65 may be added to receive coat hangers, towels and the like.

While specific embodiments of the present invention have been described above, it will be apparent to those skilled in the art that various modifications and adaptations of the disclosed structure and method are possible without departing from the spirit and scope of the invention as defined by the claims which follow.

What is claimed is:

1. A shelf case which comprises a single generally rectangular sheet of thermally deformable material, the sheet having:

first and second spaced apart axes each of which extends from one side edge to the opposite side edge parallel to and spaced from the end edges;

third and fourth spaced apart axes each of which extends longitudinally from one end edge to the opposite end edge perpendicular to the first and second axes and spaced from the side edges to define first and second sidewall portions each comprising portions of the sheet adjoined to a side edge;

a continuous cut which terminates at both ends within the sheet, the cut having a first portion which extends along the second axis from the third axis to the fourth axis defining the frontal edge of a shelf, second and third portions which extend along the third and fourth axes respectively from the first axis to the second axis defining shelf ends having tabs, fourth and fifth portions which respectively extend along the first axis from the third axis toward the one side edge and from the fourth axis toward the opposite side edge defining tab receiving slots, the cut further defining a pair of opposed apertures at the intersections of the second and third portions with the fourth and fifth portions respectively, the apertures facilitating the making of the cut by providing a convenient area for a machine tool to enter the sheet and start the cut with minimal danger of damage to the sheet resulting from drifting of the tool;

and wherein the sheet has been heated and bent along the first axis between the third and fourth axes to form the shelf perpendicular to the original plane of the sheet, and the sheet has been heated and bent along the third and fourth axes to define the sidewall portions of the shelf perpendicular to the original plane of the sheet with a rear wall therebetween, the apertures providing the necessary clearance to allow the tabs to be inserted into the slots without buckling adjacent portions of the sheet, and further wherein the tabs are free to move within the slots so that the shelf case can flex upon impact to minimize damage thereto.

* * * * *